US008915123B2

(12) United States Patent
Harrison et al.

(10) Patent No.: US 8,915,123 B2
(45) Date of Patent: Dec. 23, 2014

(54) METHODS AND APPARATUS FOR DETERMINING A VISCOSITY OF OIL IN A MIXTURE

(75) Inventors: Christopher Harrison, Auburndale, MA (US); Andreas Hausot, Setagaya-Ku (JP); Matthew T. Sullivan, Westwood, MA (US); Sophie Godefroy, Abingdon (GB)

(73) Assignee: Schlumberger Technology Corporation, Sugar Land, TX (US)

( * ) Notice: Subject to any disclaimer, the term of this patent is extended or adjusted under 35 U.S.C. 154(b) by 411 days.

(21) Appl. No.: 13/434,863

(22) Filed: Mar. 30, 2012

(65) Prior Publication Data

US 2013/0255368 A1 Oct. 3, 2013

(51) Int. Cl.
*G01N 37/00* (2006.01)
*E21B 49/08* (2006.01)

(52) U.S. Cl.
USPC ..... 73/61.43; 73/152.42

(58) Field of Classification Search
CPC ..... E21B 49/081; E21B 49/085
USPC ..... 73/61.43, 152.42; 702/12
See application file for complete search history.

(56) References Cited

U.S. PATENT DOCUMENTS

| | | | | |
|---|---|---|---|---|
| 5,070,725 | A * | 12/1991 | Cox et al. | 73/61.44 |
| 5,095,758 | A * | 3/1992 | Cox et al. | 73/861.04 |
| 5,331,156 | A * | 7/1994 | Hines et al. | 250/256 |
| 5,680,899 | A * | 10/1997 | Waid et al. | 166/250.01 |
| 5,939,717 | A * | 8/1999 | Mullins | 250/255 |
| 6,474,152 | B1 * | 11/2002 | Mullins et al. | 73/152.22 |
| 6,688,176 | B2 * | 2/2004 | Storm et al. | 73/579 |
| 6,912,904 | B2 * | 7/2005 | Storm et al. | 73/579 |
| 7,114,562 | B2 | 10/2006 | Fisseler et al. | |
| 7,134,500 | B2 * | 11/2006 | Ramakrishnan et al. | 166/369 |
| 7,707,897 | B2 * | 5/2010 | Ong | 73/861.04 |
| 8,329,965 | B2 * | 12/2012 | Matthews et al. | 585/15 |
| 2009/0000390 | A1 * | 1/2009 | Duhanyan et al. | 73/861.04 |
| 2011/0061439 | A1 * | 3/2011 | Dong et al. | 73/1.03 |
| 2011/0136700 | A1 * | 6/2011 | Matthews et al. | 507/90 |
| 2012/0168153 | A1 * | 7/2012 | Joseph et al. | 166/250.03 |
| 2012/0209541 | A1 * | 8/2012 | Ong et al. | 702/45 |

OTHER PUBLICATIONS

A.I. Memon, J. Gao, S.D. Tylor, T.L. Davies, N. Jia, "A Systematic Workflow Process for Heavy Oil Characterization: Experimental Techniques and Challenges", CSUG/SPE 137006, pp. 1-18.

M.-J. Tsang Mui Ching, Andrew E. Pomerantz, A. Ballard Andrews, Philip Dryden, Robert Schroeder, Oliver C. Mullins, and Christopher Harrison, "On the Nanofiltration of Asphaltene Solutions, Crude Oils, and Emulsions," Energy Fuels 2010, 24, 5028-5037: DOI:10.1021/ef100645b, 2010 American Chemical Society, pp. 5028-5037.

S.L. Kokal, "Crude Oil Emulsions," Petroleum Engineering Handbook, vol. I, Chap. 12, pp. 533-570.

Sunil Kokal, "SPE Distinguished Lecturer Series—Crude Oil Emulsions: Everything You Wanted to Know But Were Afraid to Ask," SPE Foundation, pp. 1-38.

* cited by examiner

*Primary Examiner* — John Fitzgerald
(74) *Attorney, Agent, or Firm* — Daryl R. Wright; Jody DeStefanis

(57) ABSTRACT

Methods and apparatus for determining a viscosity of oil in a mixture are disclosed herein. An example method includes determining water fractions of a mixture flowing into a downhole tool and determining viscosities of the mixture. The mixture includes water and oil. The example method also includes determining a viscosity of the oil based on the water fractions and the viscosities.

12 Claims, 6 Drawing Sheets

500
Water Fraction
0.0
0.1
0.2
0.3
0.4
12,500
16,000
Time (Seconds)

600
Viscosity (Poise)
0.1
0.2
0.3
0.4
0.5
12,500
16,000
Time (Seconds)

700
Viscosity
Water Fraction

METHODS AND APPARATUS FOR DETERMINING A VISCOSITY OF OIL IN A MIXTURE

FIELD OF THE DISCLOSURE

This disclosure relates generally to mixtures and, more particularly, to methods and apparatus for determining a viscosity of oil in a mixture.

BACKGROUND OF THE DISCLOSURE

Formation fluid flowing from a subterranean formation into a downhole tool is often a mixture of oil and water. Generally, the mixture is unstable and, therefore, the oil and the water separate over time if the mixture is static. Generally, to determine a viscosity of the oil in the formation fluid, a sample of the formation fluid is stored in a container until the oil separates from the water, or a chemical demulsifier may be added to the mixture to cause the oil and the water to separate. The oil may then be removed from the container, and a viscosity of the oil may be determined.

SUMMARY

This summary is provided to introduce a selection of concepts that are further described below in the detailed description. This summary is not intended to identify key or essential features of the claimed subject matter, nor is it intended to be used as an aid in limiting the scope of the claimed subject matter.

An example method disclosed herein includes determining water fractions of a mixture flowing into a downhole tool and determining viscosities of the mixture. The mixture includes water and oil. The example method also includes determining a viscosity of the oil based on the water fractions and the viscosities.

Another example method disclosed herein includes determining a viscosity of a flowing mixture as a function of a fraction of a dispersed phase of the mixture and extrapolating the fraction of the dispersed phase to zero.

BRIEF DESCRIPTION OF THE DRAWINGS

Embodiments of methods and apparatus for determining a viscosity of oil in a mixture are described with reference to the following figures. The same numbers are used throughout the figures to reference like features and components.

DETAILED DESCRIPTION

In the following detailed description, reference is made to the accompanying drawings, which form a part hereof, and within which are shown by way of illustration specific embodiments by which the examples described herein may be practiced. It is to be understood that other embodiments may be utilized and structural changes may be made without departing from the scope of the disclosure.

One or more aspects of the present disclosure relate to determining a viscosity of oil in a mixture. In some examples, apparatus and methods disclosed herein are implemented in a downhole tool and/or wireline-conveyed tools such as a Modular Formation Dynamics Tester (MDT) of Schlumberger Ltd.

Example methods disclosed herein may include determining water fractions of a mixture flowing into a downhole tool and determining viscosities of the mixture. The mixture may include water and oil. In some examples, formation fluid in a subterranean formation may be a mixture including oil and water (i.e., a suspension and/or dispersion of water in oil or oil in water). As the formation fluid flows into the downhole or wireline-conveyed tool, water fractions of the formation fluid may decrease monotonically. The water fractions of the mixture may be determined by determining optical densities of the mixture. The viscosities of the mixture may be determined by increasing a stability or emulsification of the mixture (e.g., by agitating the mixture) and using a vibrating wire viscometer. The example methods may also include determining a viscosity of the oil based on the water fractions and the viscosities. The viscosity of the oil may be determined by determining a viscosity of the mixture as a function of the water fraction of the mixture and extrapolating the water fraction of the mixture to zero.

Figure 1:
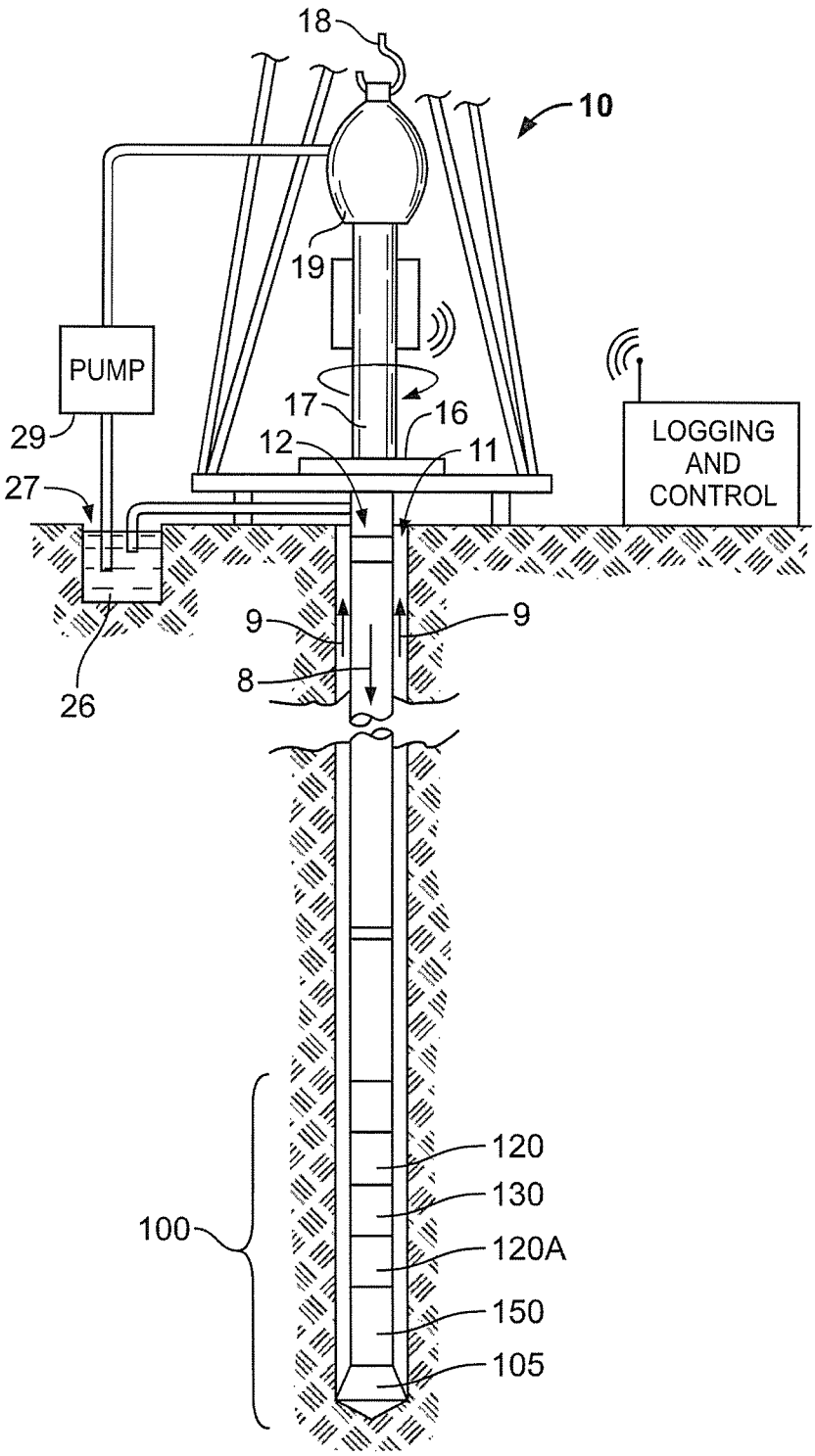
FIG. 1 illustrates an example system in which embodiments of example methods and apparatus for determining a viscosity of oil in a mixture can be implemented.

FIG. 1 illustrates a wellsite system in which the present invention can be employed. The wellsite can be onshore or offshore. In this example system, a borehole 11 is formed in subsurface formations by rotary drilling in a manner that is well known. Embodiments can also use directional drilling, as will be described hereinafter.

A drill string 12 is suspended within the borehole 11 and has a bottom hole assembly 100 which includes a drill bit 105 at its lower end. The surface system includes platform and derrick assembly 10 positioned over the borehole 11. The assembly 10 includes a rotary table 16, kelly 17, hook 18 and rotary swivel 19. The drill string 12 is rotated by the rotary table 16, energized by means not shown, which engages the kelly 17 at the upper end of the drill string 12. The drill string 12 is suspended from the hook 18, attached to a traveling block (also not shown), through the kelly 17 and the rotary swivel 19, which permits rotation of the drill string 12 relative to the hook 18. As is well known, a top drive system could alternatively be used.

In the example of this embodiment, the surface system further includes drilling fluid or mud 26 stored in a pit 27 formed at the well site. A pump 29 delivers the drilling fluid 26 to the interior of the drill string 12 via a port in the swivel 19, causing the drilling fluid 26 to flow downwardly through the drill string 12 as indicated by the directional arrow 8. The drilling fluid 26 exits the drill string 12 via ports in the drill bit 105, and then circulates upwardly through the annulus region between the outside of the drill string and the wall of the borehole, as indicated by the directional arrows 9. In this well known manner, the drilling fluid 26 lubricates the drill bit 105 and carries formation cuttings up to the surface as it is returned to the pit 27 for recirculation.

The bottom hole assembly 100 of the illustrated embodiment includes a logging-while-drilling (LWD) module 120, a measuring-while-drilling (MWD) module 130, a roto-steerable system and motor 150, and drill bit 105.

The LWD module 120 is housed in a special type of drill collar, as is known in the art, and can contain one or a plurality of known types of logging tools. It will also be understood that more than one LWD and/or MWD module can be employed, e.g. as represented at 120A. (References, throughout, to a module at the position of 120 can alternatively mean a module at the position of 120A as well.) The LWD module 120 includes capabilities for measuring, processing, and storing information, as well as for communicating with the surface equipment. In the present embodiment, the LWD module 120 includes a fluid sampling device.

The MWD module 130 is also housed in a special type of drill collar, as is known in the art, and can contain one or more devices for measuring characteristics of the drill string 12 and drill bit 105. The MWD tool further includes an apparatus (not shown) for generating electrical power to the downhole system. This may include a mud turbine generator powered by the flow of the drilling fluid, it being understood that other power and/or battery systems may be employed. In the present embodiment, the MWD module 130 includes one or more of the following types of measuring devices: a weight-on-bit measuring device, a torque measuring device, a vibration measuring device, a shock measuring device, a stick slip measuring device, a direction measuring device, and an inclination measuring device.

Figure 2:
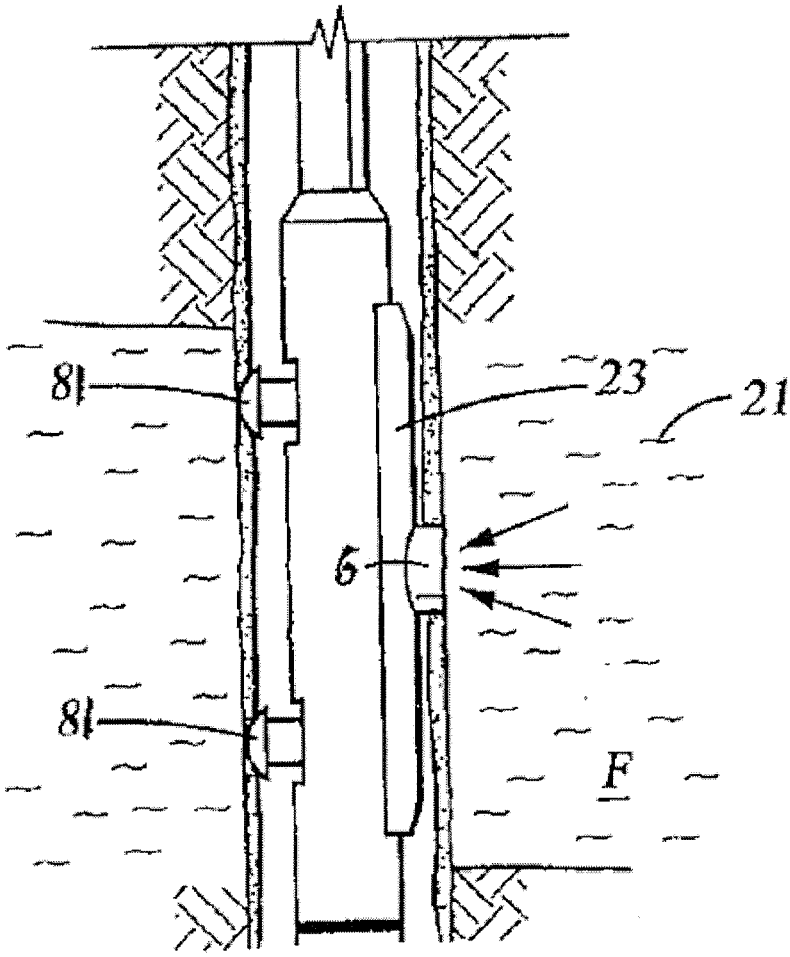
FIG. 2 illustrates another example system in which embodiments of the example methods and apparatus for determining a viscosity of oil in a mixture can be implemented.

FIG. 2 is a simplified diagram of a sampling-while-drilling logging device of a type described in U.S. Pat. No. 7,114,562, incorporated herein by reference in its entirety, utilized as the LWD tool 120 or part of an LWD tool suite 120A. The LWD tool 120 is provided with a probe 6 for establishing fluid communication with a formation F and drawing fluid 21 into the tool, as indicated by the arrows. The probe 6 may be positioned in a stabilizer blade 23 of the LWD tool and extended therefrom to engage the borehole wall. The stabilizer blade 23 comprises one or more blades that are in contact with the borehole wall. Fluid drawn into the downhole tool using the probe 6 may be measured to determine, for example, pretest and/or pressure parameters. Additionally, the LWD tool 120 may be provided with devices, such as sample chambers, for collecting fluid samples for retrieval at the surface. Backup pistons 81 may also be provided to assist in applying force to push the drilling tool and/or the probe 6 against the borehole wall.

Figure 3:
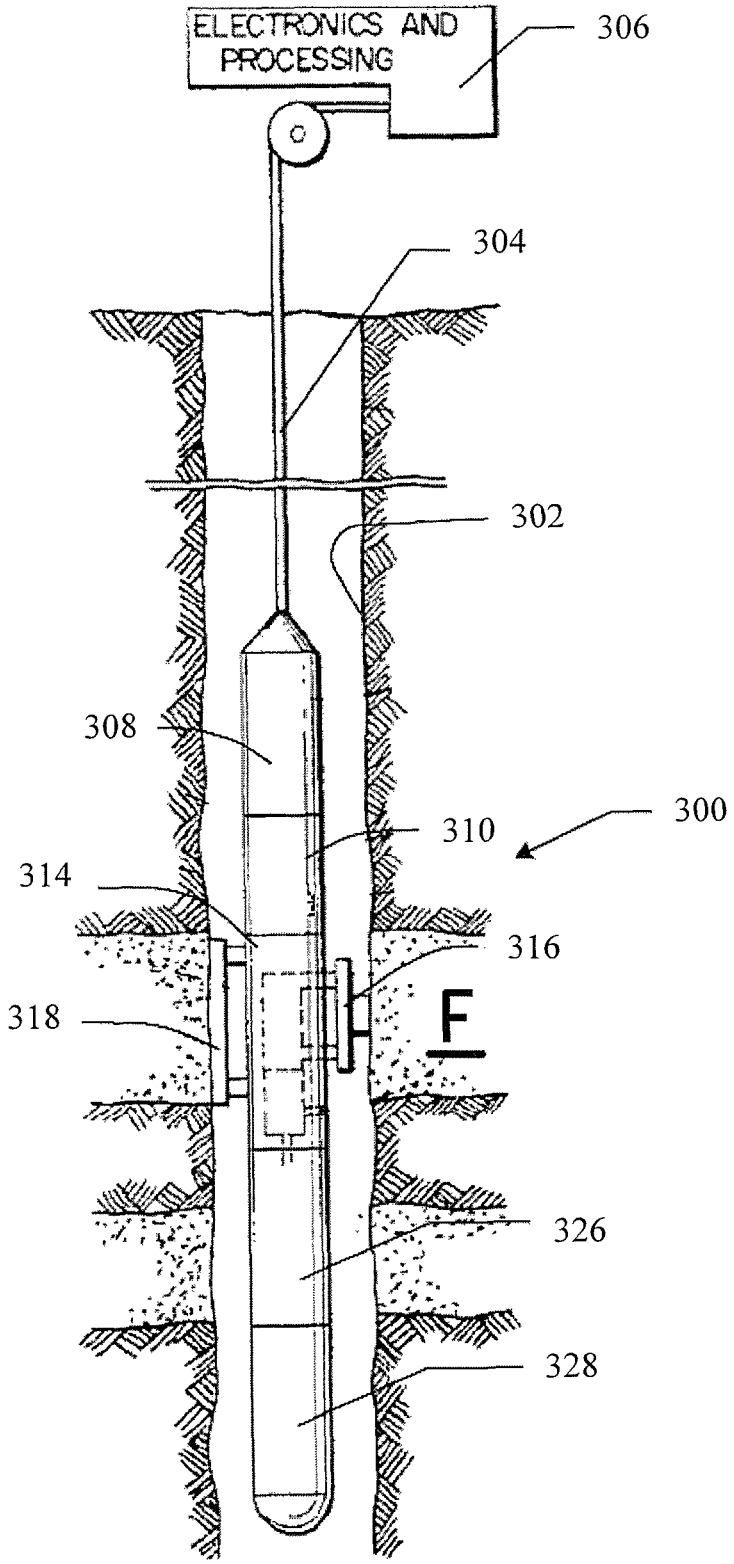
FIG. 3 illustrates another example system in which embodiments of the example methods and apparatus for determining a viscosity of oil in a mixture can be implemented.

Referring to FIG. 3, shown is an example wireline tool 300 that may be another environment in which aspects of the present disclosure may be implemented. The example wireline tool 300 is suspended in a wellbore 302 from the lower end of a multiconductor cable 304 that is spooled on a winch (not shown) at the Earth's surface. At the surface, the cable 304 is communicatively coupled to an electronics and processing system 306. The example wireline tool 300 includes an elongated body 308 that includes a formation tester 314 having a selectively extendable probe assembly 316 and a selectively extendable tool anchoring member 318 that are arranged on opposite sides of the elongated body 308. Additional components (e.g., 310) may also be included in the tool 300.

The extendable probe assembly 316 may be configured to selectively seal off or isolate selected portions of the wall of the wellbore 302 to fluidly couple to an adjacent formation F and/or to draw fluid samples from the formation F. Accordingly, the extendable probe assembly 316 may be provided with a probe having an embedded plate, as described above. The formation fluid may be expelled through a port (not shown) or it may be sent to one or more fluid collecting chambers 326 and 328. In the illustrated example, the electronics and processing system 306 and/or a downhole control system are configured to control the extendable probe assembly 316 and/or the drawing of a fluid sample from the formation F.

Figure 4:
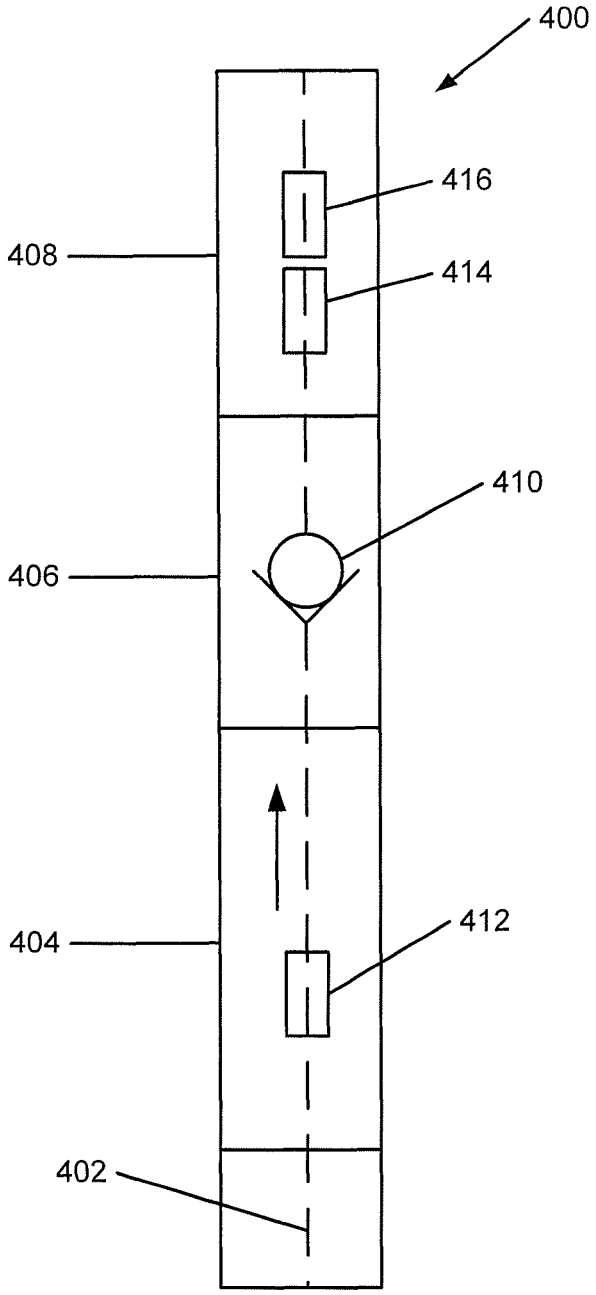
FIG. 4 illustrates various components of an example device that can implement embodiments of the example methods and apparatus for determining a viscosity of oil in a mixture.

FIG. 4 illustrates a portion of an example downhole tool 400 that may be used to determine a viscosity of oil in a mixture. The example downhole tool 400 is a Modular Formation Dynamics Tester (MDT) of Schlumberger Ltd. The example downhole tool 400 includes a flowline 402 to receive formation fluid from a subterranean formation. The flowline 402 extends through a first fluid analyzer module 404, a pump-out module (MRPO) 406, and a second fluid analyzer module 408. The MRPO 406 includes a pump (not shown) to extract the formation fluid from the subterranean formation and/or pump the formation fluid through the flowline 402. In the illustrated example, the MRPO 406 includes at least one fluid agitator 410 (e.g., a check valve, a pump, a mixer, a flow area restriction, etc.) disposed along the flowline 402. In the illustrated example, the fluid agitator 410 is a check valve.

The first fluid analyzer module 404 and/or the second fluid analyzer module 408 include one or more optical tools 412 and 414 (e.g., a In Situ Fluid Analyzer (IFA) of Schlumberger Ltd., a Live Fluid Analyzer (LFA) of Schlumberger Ltd., a Composition Fluid Analyzer (CFA) of Schlumberger Ltd., and/or any other suitable optical tool) disposed along the flowline 402 to determine a variety of characteristics (e.g., hydrocarbon composition, gas/oil ratio, live-oil density, pH of water, fluid color, etc.) and/or fluid concentrations (e.g., concentrations of methane, ethane-propane-butane-pentane, water, carbon dioxide, and/or other fluids) of the formation fluid flowing through the flowline 402. In some examples, the optical tools 412 and 414 are disposed along the flowline 402 upstream and/or downstream of the fluid agitator 410. In the illustrated example, the optical tools 412 and 414 are disposed upstream and downstream of the fluid agitator 410 along the flowline 402. The optical tools 412 and 414 include one or more sensors (not shown) to determine water fractions of the formation fluid by determining optical densities of the formation fluid.

The second fluid analyzer module 408 also includes at least one viscometer 416 such as, for example, a vibrating wire viscometer, a vibrating rod viscometer, and/or any other suitable viscometer. The viscometer 416 is disposed along the flowline 402 downstream of the fluid agitator 410 and the optical tools 412 and 414 to determine viscosities of the formation fluid.

During operation, the formation fluid flows from the subterranean formation into the downhole tool 400. The formation fluid is a mixture including oil and water (i.e., a suspension and/or dispersion of oil in water or water in oil). In some examples, water-based drilling fluid or oil-based drilling fluid is colloidally suspended and/or dispersed in the formation fluid flowing into the downhole tool 400. The formation fluid flows into the flowline 402 and through the first fluid analyzer module 404, the MRPO 406, and the second fluid analyzer module 408. As the formation fluid flows through the flowline 402, the first optical tool 412 and/or the second optical tool 414 determine water fractions of the formation fluid by determining optical densities of the formation fluid.

After the formation fluid flows through the first fluid analyzer module 404, the formation fluid flows through the fluid agitator 410 disposed in the MRPO 406. The formation fluid is agitated (i.e., sheared) via the fluid agitator 410 to cause droplets of the water (i.e., the dispersed phase) in the formation fluid to decrease in size. In some examples, the fluid agitator 410 is to cause the water droplets to disperse substantially uniformly throughout a continuous phase (e.g., oil) of the formation fluid. As a result, a stability and/or an emulsification of the formation fluid is increased (i.e., the mixture tightens and/or emulsifies). After the formation fluid is agitated via the fluid agitator 410, the viscometer 416 determines viscosities of the formation fluid. In some examples, the viscosities of the formation fluid are determined based on a shear rate of the viscometer 416. As described in greater detail below, based on the viscosities and the water fractions, the viscosity of only the oil in the formation fluid is determined.

Figure 5:
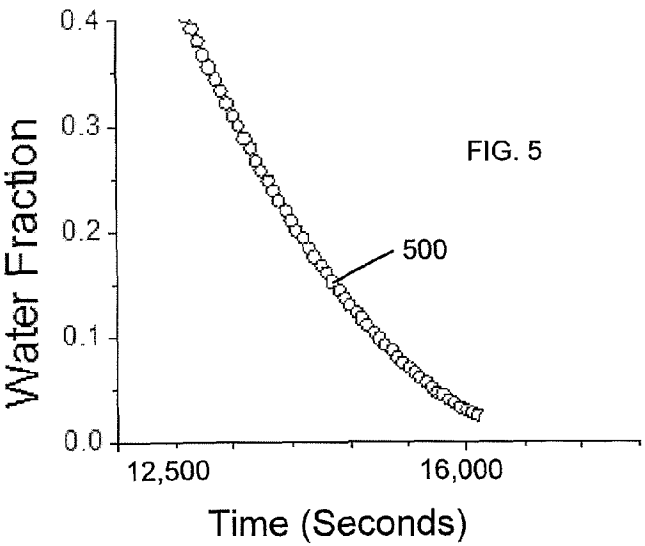
FIG. 5 illustrates a chart that plots water fractions of an example mixture over time.

FIG. 5 is a chart that plots the water fraction of the formation fluid over time. An example curve 500 is plotted based on the water fractions determined by the one or more of the optical tools 412 and 414. As the formation fluid is flowed into the example downhole tool 400, the water fractions of the formation fluid may decrease over time. In the illustrated example, the water fractions of the formation fluid flowing into the example downhole tool 400 are decreasing monotonically from about 12,500 seconds to about 16,000 seconds. However, the water fractions of the formation fluid are greater than zero during that time.

Figure 6:
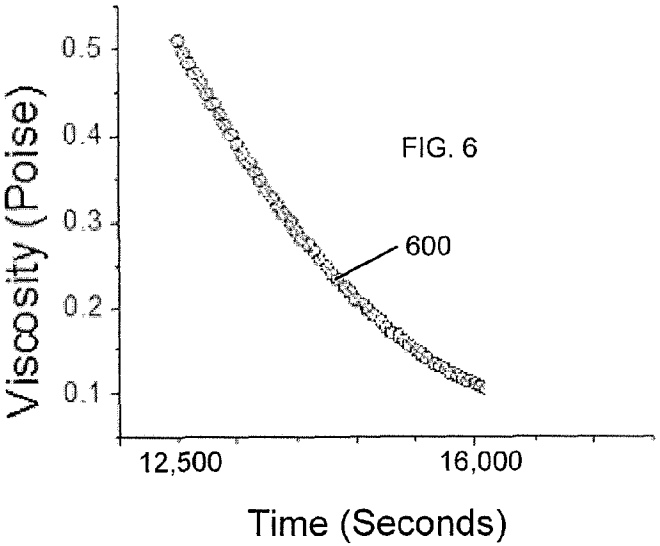
FIG. 6 illustrates a chart that plots viscosities of the example mixture over time.

FIG. 6 is a chart that plots viscosities of the formation fluid over time. An example curve 600 is plotted based on the viscosities determined by the viscometer 416. The viscosities decrease over the time as illustrated by the example curve 600. The viscosities of the formation fluid are determined when the water fractions of the formation fluid are decreasing monotonically. For example, the viscosities of the formation fluid flowing into the example downhole tool 400 are determined from about 12,500 seconds to about 16,000 seconds.

Figure 7:
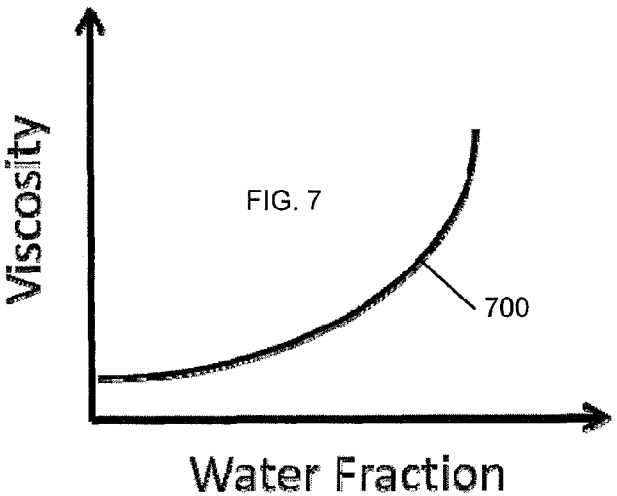
FIG. 7 illustrates a chart that plots the viscosities of the example mixture as a function of the water fractions of the mixture.

FIG. 7 is a chart that plots the viscosities of the formation fluid as a function of the water fractions of the formation fluid. An example curve 700 depicted in FIG. 7 is plotted using the example curves 500 and 600 of FIGS. 5 and 6. For example, the x-axes of the example charts of FIGS. 5 and 6 are both represent time (e.g., seconds). Thus, by combining the curves 500 and 600 of FIGS. 5 and 6, the viscosities over the water fractions are plotted as the example curve 700 and, thus, a viscosity of the formation fluid (i.e., the mixture of oil and water) as a function of the water fractions of the formation fluid is determined. In the illustrated example, the viscosities of the formation fluid increase as the water fractions increase such that the example curve 700 is fit using a second order polynomial equation such as, for example, Equation 1 below.

$$\text{Viscosity}_{mixture}=A+B(\text{Water Fraction})+C(\text{Water Fraction})^2. \quad \text{Equation (1)}$$

In Equation 1, A is the viscosity of the oil in units of centipoise (cP) and B and C are constants in units of centipoise (cP). The water fraction is unitless. The viscosity of the oil in the formation fluid is determined by extrapolating the water fraction of the formation fluid to zero. For example, using values from the curve 700 of FIG. 7 and Equation 1, values of A, B, and C are determined and, thus, the viscosity of only the oil (i.e., A) in the formation fluid is determined.

Figure 8:
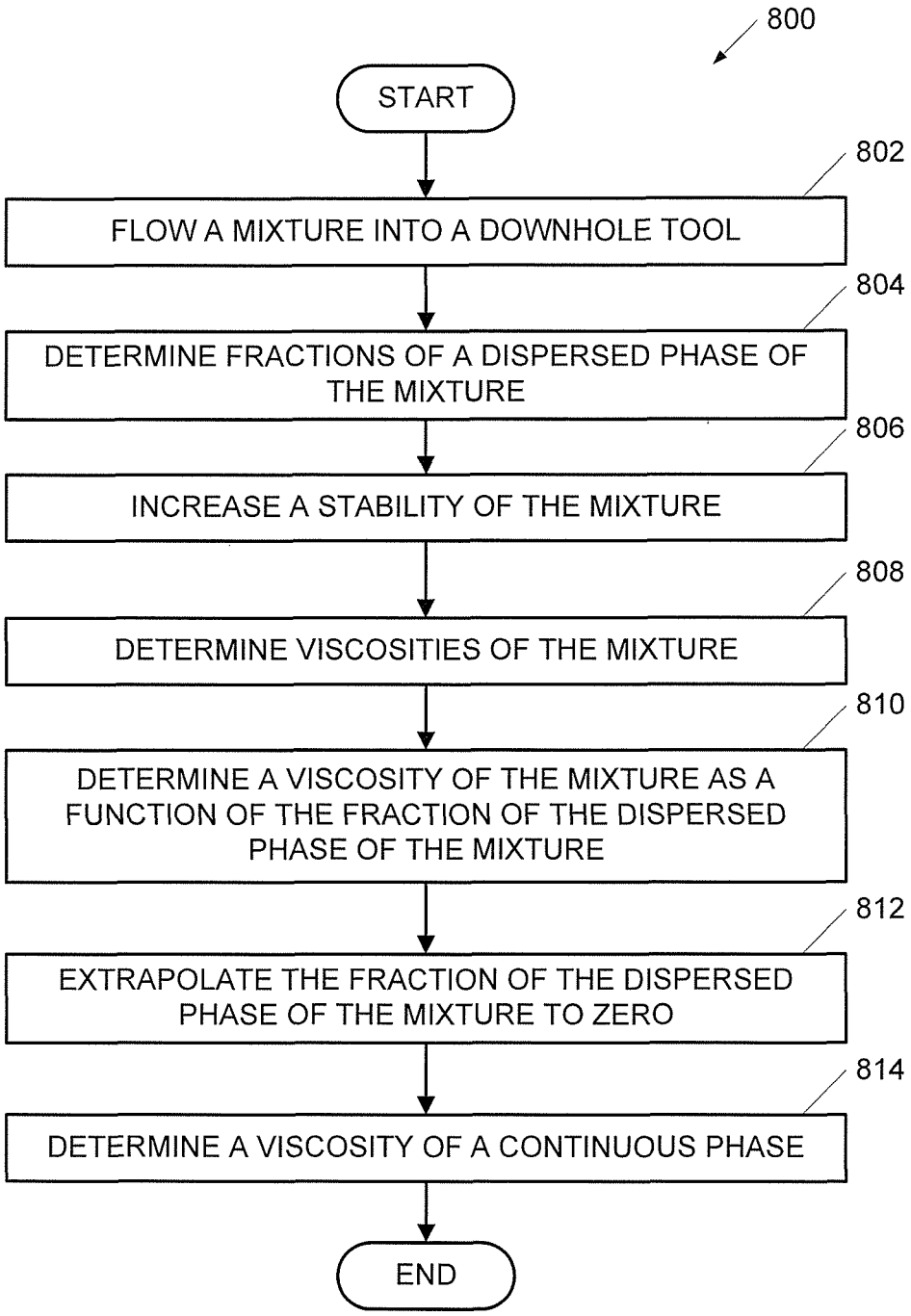
FIG. 8 illustrates example methods for determining a viscosity of oil in a mixture in accordance with one or more embodiments.

FIG. 8 depicts an example flow diagram representative of processes that may be implemented using, for example, computer readable instructions. The example process of FIG. 8 may be performed using a processor, a controller and/or any other suitable processing device. For example, the example processes of FIG. 8 may be implemented using coded instructions (e.g., computer readable instructions) stored on a tangible computer readable medium such as a flash memory, a read-only memory (ROM), and/or a random-access memory (RAM). As used herein, the term tangible computer readable medium is expressly defined to include any type of computer readable storage and to exclude propagating signals. Additionally or alternatively, the example process of FIG. 8 may be implemented using coded instructions (e.g., computer readable instructions) stored on a non-transitory computer readable medium such as a flash memory, a read-only memory (ROM), a random-access memory (RAM), a cache, or any other storage media in which information is stored for any duration (e.g., for extended time periods, permanently, brief instances, for temporarily buffering, and/or for caching of the information). As used herein, the term non-transitory computer readable medium is expressly defined to include any type of computer readable medium and to exclude propagating signals.

Alternatively, some or all of the example process of FIG. 8 may be implemented using any combination(s) of application specific integrated circuit(s) (ASIC(s)), programmable logic device(s) (PLD(s)), field programmable logic device(s) (FPLD(s)), discrete logic, hardware, firmware, etc. Also, one or more operations depicted in FIG. 8 may be implemented manually or as any combination(s) of any of the foregoing techniques, for example, any combination of firmware, software, discrete logic and/or hardware. In some examples, the example process of FIG. 8 may be implemented using the electronics and processing system 306, a logging and control system at the surface, and/or a downhole control system. Further, one or more operations depicted in FIG. 8 may be implemented at the surface and/or downhole.

Further, although the example process of FIG. 8 is described with reference to the flow diagram of FIG. 8, other methods of implementing the process of FIG. 8 may be employed. For example, the order of execution of the blocks may be changed, and/or some of the blocks described may be changed, eliminated, sub-divided, or combined. Additionally, one or more of the operations depicted in FIG. 8 may be performed sequentially and/or in parallel by, for example, separate processing threads, processors, devices, discrete logic, circuits, etc.

FIG. 8 depicts an example process 800 that may be used with one of the example downhole tools of FIGS. 1-4. The example process begins by flowing a mixture into the downhole tool 400 (block 802). In some examples, a continuous phase of the mixture is oil, and a dispersed phase of the mixture is aqueous (e.g., water). The MRPO 406 may pump the formation fluid from the subterranean formation into the downhole tool 400 and/or through the flowline 402. At block 804, fractions of the dispersed phase of the mixture are determined. For example, the first optical tool 412 and/or the second optical tool 414 (e.g., the IFA, LFA, CFA, etc.) determine fractions of the dispersed phase of the mixture by determining optical densities of the mixture. As the mixture is flowed from the subterranean formation into the downhole tool 400, the fractions of the dispersed phase of the mixture may decrease over time. In some examples, the fractions of the dispersed phase decrease monotonically over a portion of the time.

At block 806, the stability or emulsification of the mixture is increased. For example, the mixture is agitated via the fluid agitator 410 to decrease sizes of droplets of the dispersed phase of the mixture and/or substantially uniformly disperse the droplets throughout the continuous phase. The fractions of the dispersed phase of the mixture are determined before and/or after the stability of the mixture is increased. At block 808, viscosities of the mixture are determined. For example, the viscometer 416 (e.g., a vibrating wire viscometer, a vibrating rod viscometer, etc.) determines the viscosities of the mixture. The viscosities are determined when the fractions of the dispersed phase of the mixture are decreasing monotonically.

At block 810, a viscosity of the mixture as a function of the fraction of the dispersed phase of the mixture is determined. For example, the viscosity of the mixture as a function of the fraction of the dispersed phase may be determined by using the viscosities and the fractions of the dispersed phase determined when the water fractions are decreasing monotically. At block 812, the water fraction of the dispersed phase of the mixture is extrapolated to zero. For example, the water fraction of the dispersed phase may be extrapolated to zero using a second order polynomial equation representing the viscosity of the mixture as a function of the fraction of the dispersed phase such as, for example, Equation 1. Thus, at block 814, a viscosity of the continuous phase (i.e., the oil) of the mixture is determined.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. §112, paragraph 6 for any limitations of any of the claims herein, except for those in which the claim expressly uses the words 'means for' together with an associated function.

The Abstract at the end of this disclosure is provided to comply with 37 C.F.R. §1.72(b) to allow the reader to quickly ascertain the nature of the technical disclosure. It is submitted with the understanding that it will not be used to interpret or limit the scope or meaning of the claims.

What is claimed is:

1. A method, comprising:

determining water fractions of a mixture flowing into a downhole tool, wherein the mixture includes water and oil;

determining viscosities of the mixture; and determining a viscosity of the oil based on the water fractions and the viscosities.

2. The method of claim 1 wherein the viscosities of the mixture are determined using a vibrating wire viscometer.

3. The method of claim 1 wherein determining the water fractions of the mixture comprises determining optical densities of the mixture.

4. The method of claim 1 wherein determining a viscosity of the oil comprises:

determining a viscosity of the mixture as a function of the water fraction of the mixture; and extrapolating the water fraction of the mixture to zero.

5. The method of claim 1 wherein the viscosities of the mixture are determined when the water fractions of the mixture are decreasing monotonically.

6. The method of claim 1 wherein determining the viscosities of the mixture comprises increasing a stability of the mixture.

7. The method of claim 6 wherein increasing the stability of the mixture comprises agitating the mixture.

8. A tangible article of manufacture storing machine readable instructions which, when executed, cause a machine to:

determine water fractions of a mixture flowing into a downhole tool, wherein the mixture includes water and oil;

determine viscosities of the mixture; and determine a viscosity of the oil based on the water fractions and the viscosities.

9. The tangible article of manufacture of claim 8 wherein the machine readable instructions, when executed, cause the machine to determine the viscosities of the mixture when the water fractions are decreasing monotonically.

10. The tangible article of manufacture of claim 8 wherein the machine readable instructions, when executed, cause the machine to determine the viscosities of the mixture via a vibrating wire viscometer.

11. The tangible article of manufacture of 8 wherein the machine readable instructions, when executed, cause the machine to determine the water fractions of the mixture by determining optical densities of the mixture.

12. The tangible article of manufacture of claim 8 wherein the machine readable instructions, when executed, cause the machine to determine a viscosity of the oil by:

determining a viscosity of the mixture as a function of the water fraction of the mixture; and extrapolating the water fraction of the mixture to zero.

* * * * *